United States Patent [19]

Matherly

[11] 4,188,940

[45] Feb. 19, 1980

[54] WOOD OR COAL BURNING STOVE HAVING A TOP WITH A PIVOTABLE LID FOR TOP LOADING OF WOOD OR COAL INTO THE STOVE

[76] Inventor: Foster Matherly, 137 Franklin St., Rocky Mount, Va. 24151

[21] Appl. No.: 871,593

[22] Filed: Jan. 23, 1978

[51] Int. Cl.[2] ..... F24C 15/10

[52] U.S. Cl. ..... 126/217; 126/211; 220/334

[58] Field of Search ..... 126/217, 220, 211, 58, 126/335; 220/334, 343

[56] References Cited

U.S. PATENT DOCUMENTS

| | | | |
|---|---|---|---|
| 123,975 | 2/1872 | Britton | 126/211 |
| D. 237,798 | 11/1975 | Fisher | D23/72 |
| 2,124,481 | 7/1938 | Anderson | 220/334 |
| 2,314,673 | 3/1943 | Walker | 220/334 |
| 2,681,165 | 6/1954 | Kornhauser | 220/334 |
| 3,841,466 | 10/1974 | Hoffman | 220/334 |

FOREIGN PATENT DOCUMENTS

| | | | |
|---|---|---|---|
| 969634 | 5/1950 | France | 126/211 |
| 600683 | 4/1948 | United Kingdom | 126/220 |

*Primary Examiner*—Samuel Scott
*Assistant Examiner*—Gerald Anderson
*Attorney, Agent, or Firm*—Stevens, Davis, Miller & Mosher

[57] ABSTRACT

This invention relates to a wood or coal burning stove having a bottom, sidewalls, front and rear end walls and a top. The front end wall has a wood or coal loading opening therein and a door normally closes the opening. The door is openable for loading of wood or coal into the stove through the opening. The top includes a stationary substantially horizontally extending tier remote from the front end wall and a further wall extending from the tier in a direction downward and toward the front end wall. The further wall defines a horizontally extending recess at the lower end thereof which opens in a direction toward the front end wall. The top further includes a lid pivotable about a horizontal axis, immediately adjacent the upper end of the further wall, from a normally closed substantially horizontally extending position in which the lid extends into the recess and effectively closes off the stove from the outside air to an open position, in which the lid swings out of the recess initially in a direction upwardly and toward the front end wall, for loading of wood or coal into the stove from the top. The lid comprises a planar section which when the lid is closed extends horizontally outwardly beyond the front end wall and the sidewalls. The lid also includes a lip section substantially perpendicular to and extending from the planar section. The lip section extends along in close proximity to and is parallel to the exterior of the front end wall and the sidewalls when the lid is closed to further effectively close off the stove to outside air.

1 Claim, 3 Drawing Figures

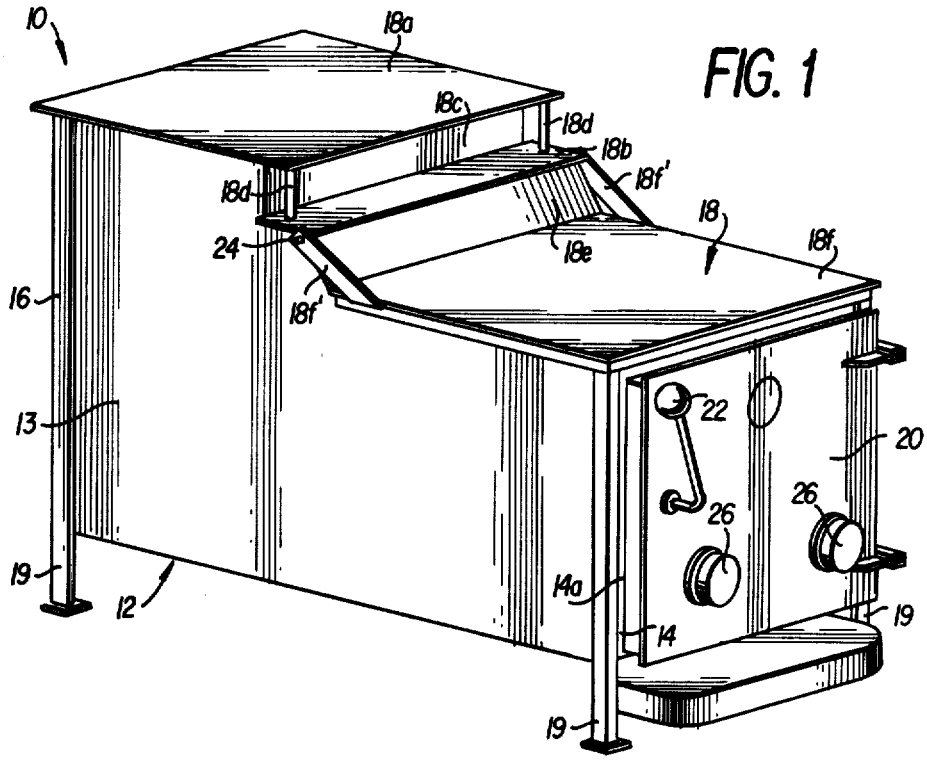
FIG. 1
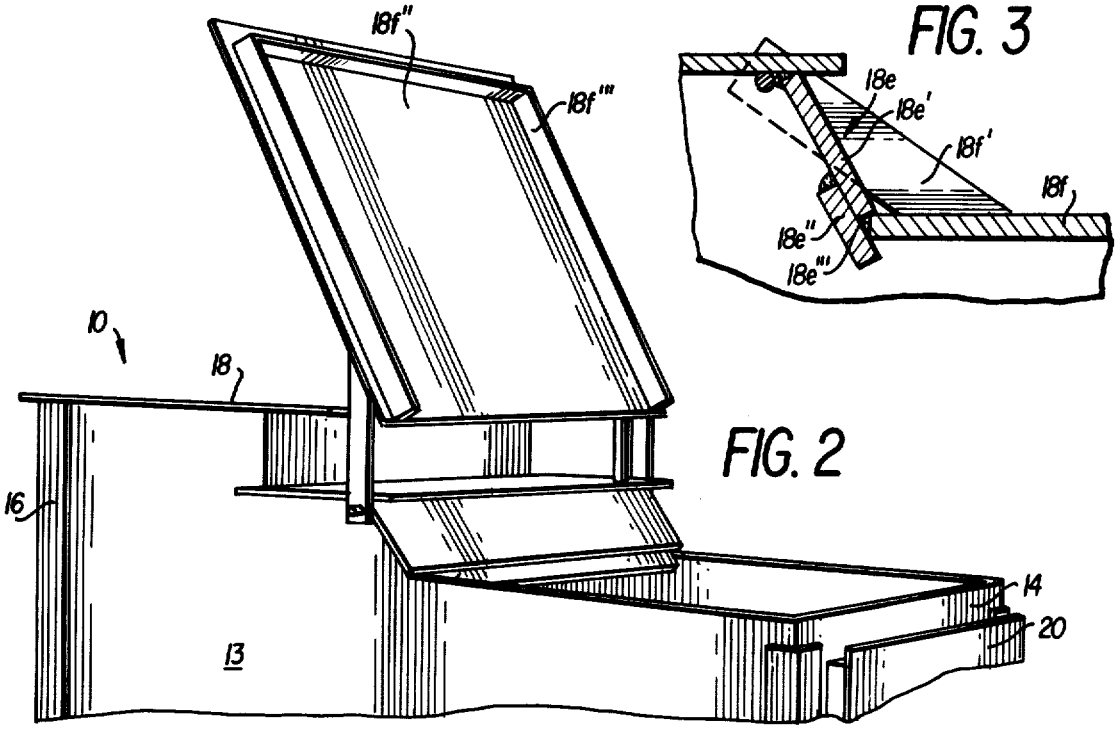
FIG. 2
FIG. 3

WOOD OR COAL BURNING STOVE HAVING A TOP WITH A PIVOTABLE LID FOR TOP LOADING OF WOOD OR COAL INTO THE STOVE

BACKGROUND OF THE INVENTION

This invention relates to a stove in which wood or coal may be burned and more particularly to a wood or coal burning stove which may be easily loaded with wood or coal from the top of the stove.

In wood or coal burning stoves, it is desirable that the wood or coal be loadable as easily as possible into the stove. At the same time, it is desirable that a minimum amount of outside air enter the stove when wood or coal is being burned so that the fuel smolders and does not burn rapidly, and therefore is not consumed too quickly. This result is desirable since less fuel will be consumed per unit time.

SUMMARY OF THE INVENTION

An object of this invention is to provide a wood or coal burning stove which is easily loadable from the top with wood or coal and which is effectively closed off from the outside air when wood or coal is being burned in the stove so that the desired minimum amount of outside air enters the stove for fuel combustion.

A further object of this invention is to provide a wood or coal burning stove of the type described in the first object which can also be loaded from the front if desired.

These and other objects are accomplished by providing a wood or coal burning stove made of cast iron having a bottom, sidewalls, front and rear end walls and a top. The front end wall has a wood or coal loading opening therein and a door normally closes the opening to block undesired flow of any considerable amount of outside air therethrough into the stove when wood or coal is being burned. The door is easily openable for loading of wood or coal into the stove through the opening.

The top includes at least one stationary substantially horizontally extending tier remote from the front end wall and a further wall extending from the tier in a direction downward and toward the front end wall. The further wall defines a horizontally extending recess at the lower end thereof which opens in a direction toward the front end wall. The further wall comprises a first plate directly connected to and extending from the tier in a direction downward and toward the front end wall, and a second plate directly connected to the lower end of the face of the first plate most remote from the front end wall and extending from the first plate in that direction. The recess is defined by the lower edge of the first plate and the face of the second plate which is closest to the front end wall. The top further includes a lid pivotable about a horizontal axis, immediately adjacent the upper end of the first plate, from a normally closed substantially horizontally extending position in which the lid extends into the recess and effectively closes off the stove from the outside air to an open position, in which the lid swings out of the recess initially in a direction upwardly and toward the front end wall, for loading of wood or coal into the stove from the top.

The lid comprises a planar section which when the lid is closed extends horizontally outwardly beyond the front end wall and the sidewalls. The lid also includes a lip section substantially perpendicular to and extending from the planar section. The lip section extends along in close proximity to and is parallel to the exterior of the front end wall and the sidewalls when the lid is closed to further effectively close off the stove to outside air.

BRIEF DESCRIPTION OF THE DRAWINGS

FIG. 1 is a perspective view of a wood or coal burning stove of the invention with the loading lid shown in closed position;

FIG. 2 is a view similar to FIG. 1 but showing the loading lid in open position; and FIG. 3 is a cross-sectional view on an enlarged scale of the top of the stove shown in FIGS. 1 and 2.

DESCRIPTION OF THE PREFERRED EMBODIMENTS

Shown in FIGS. 1 and 2 is a wood or coal burning stove 10 preferably made of sheet iron having a closed bottom 12, sidewalls 13, a front end wall 14, a rear end wall 16, a top 18, and four legs 19. The interior of the sidewalls 13 and the rear end wall 16 are lined with fire brick for improved heating efficiency. The front end wall 14 has a wood or coal loading opening **14*a* therein and a hinged door 20 normally closes the opening 14*a* to block undesired flow of any considerable amount of outside air therethrough into the stove 10 when wood or coal is being burned. The hinged door 20 is easily openable by a handle 20 for loading of wood or coal into the stove through the opening 14*a*. The handle 20** operates a latch to secure the door when it is in the closed position.

The top 18 includes a first stationary substantially horizontally extending tier **18*a* adjacent the rear end wall 16, a second stationary substantially horizontally extending tier 18*b*, a vertical wall member 18*c*, two vertical posts 18*d* interconnecting the tiers 18*a* and 18*b*, and a further wall 18*e* directly rigidly connected to the second tier 18*b* and extending therefrom in a direction downward and toward the front end wall 14. The further wall 18*e* comprises a first plate 18*e'* directly connected to and extending from the second tier 18*b* in a direction downward and toward the front end wall 14, and a second plate 18*e''* connected to the lower end of the face of the first plate 18*e'* most remote from the front end wall 14 and extending from the first plate 18*e'* in that direction. The first and second plates 18*e'* and 18*e''* together define a horizontally extending recess 18*e'''* which opens in a direction toward the front end wall 14. The recess 18*e'''* is defined by the lower edge of the first plate 18*e'* and the face of the second plate 18*e''* which is closest to the front end wall 14**.

The top 18 further includes a lid **18*f* pivotable about a horizontal axis, immediately adjacent the upper end of the first plate 18*e'*, from a normally closed substantially horizontally extending position (FIG. 1) in which the lid 18*f* extends into the recess 18*e'''* (FIG. 3) and effectively closes off the stove 10 from the outside air to an open position (FIG. 2), in which the lid 18*f* swings out of the recess 18*e'''* in a direction upwardly and toward the front end wall 14, for loading of wood or coal into the stove from the top. As shown particularly in FIGS. 1 and 3, the lid 18*f* is pivotable about horizontal pins 24 and is so connected to the pins 24 by arm members 18*f'* which are rigidly connected to the lid 18*f* but freely rotatable about the pins 24**.

The lid **18*f* comprises a planar section 18*f''* which when the lid 18*f* is closed (FIG. 1) extends horizontally outwardly beyond the front end wall 14 and the sidewalls 13. The lid 18***f* also includes a lip section 18*f*''' (FIG. 2) substantially perpendicular to and extending from the planar section 18*f*''. The lip section 18*f*''' extends along in close proximity to and is parallel to the exterior of the front end wall 14 and the sidewalls 13 when the lid 18*f* is closed to further effectively close off the stove 10 to outside air.

Smoke from the burning wood or coal may be emitted from the stove through a flue which may extend into the stove through an opening in the rear end wall 16. The amount of desired air flow into the stove can be controlled by adjustable draft controls 26.

While a specific preferred embodiment of the invention has been described above, various changes and modifications within the scope of the invention as defined by the appended claims may occur to those skilled in the art of wood and coal burning stoves.

What I claim is:

1. A wood or coal burning stove comprising:

a bottom;

sidewalls;

front and rear end walls; said front end wall having a wood or coal loading opening therein;

a door normally closing said opening but being openable for loading of wood or coal into said stove through said opening;

a top comprising:

a stationary substantially horizontally extending tier remote from said front end wall;

a further wall extending from said tier in a direction downward and toward said front end wall and defining a horizontally extending recess at the lower end thereof which opens in a direction toward said front end wall;

said further wall comprises:

a first plate directly connected to and extending from said tier in a direction downwardly and toward said front end wall;

a second plate directly connected to the lower end of the face of said first plate most remote from the front end wall and extending therefrom in said last-mentioned direction; and said recess being defined by the lower edge of said first plate and the face of said second plate closest to said front end wall;

a lid pivotable about a stationary horizontal hinge axis, immediately adjacent the upper end of said further wall, from a normally closed substantially horizontally extending position in which the lid extends into and transversely across the recess to effectively close off the stove from outside air to an open position, in which the lid swings out of the recess initially in a direction upwardly and toward the front end wall, for loading of wood or coal into the stove from the top; and first and second substantially straight rigid arms, one end of said first arm being fixedly connected to one side of said lid adjacent the end thereof closest to said recess and the other end thereof being pivotable about said stationary hinge axis, one end of said second arm being fixedly connected to the other side of said lid adjacent the end thereof closest to said recess and the other end thereof being pivotable about said stationary hinge axis.

* * * * *